US005915625A

United States Patent [19]

Focke et al.

[11] Patent Number: 5,915,625

[45] Date of Patent: Jun. 29, 1999

[54] NOZZLE UNIT FOR APPLYING GLUE

[76] Inventors: Heinz Focke, Moorstr. 64; Michael Schlenker, Alma-Rogge-Weg 1o, both of 27283 Verden; Peter Kainz, Kreetortring 132, 21147 Hamburg, all of Germany

[21] Appl. No.: 08/582,097

[22] Filed: Jan. 2, 1996

[51] Int. Cl.[6] ..... B05B 15/02

[52] U.S. Cl. ..... 239/112; 239/117; 239/121

[58] Field of Search ..... 239/104, 106, 239/112, 117, 120, 121

[56] References Cited

U.S. PATENT DOCUMENTS

| | | | |
|---|---|---|---|
| 3,908,869 | 9/1975 | Little | 222/148 |
| 3,940,063 | 2/1976 | Baumgartner et al. | 239/70 |
| 3,977,609 | 8/1976 | Gallant | 239/417.3 |
| 4,266,729 | 5/1981 | Kulke et al. | 239/117 |
| 4,895,603 | 1/1990 | Semp et al. | 134/21 |
| 4,928,882 | 5/1990 | Awano et al. | 239/112 |
| 5,044,555 | 9/1991 | Youngeberg et al. | 239/117 |
| 5,435,488 | 7/1995 | Abiko | 239/112 |

FOREIGN PATENT DOCUMENTS

| | | |
|---|---|---|
| 2302223 | 8/1973 | Germany . |
| 3634137A1 | 4/1988 | Germany . |
| 4118865A1 | 1/1992 | Germany . |
| 9316085U1 | 3/1994 | Germany . |
| 9405600U1 | 7/1994 | Germany . |
| 2267664 | 12/1993 | United Kingdom . |

*Primary Examiner*—Andres Kasnikow
*Assistant Examiner*—Lisa Ann Douglas
*Attorney, Agent, or Firm*—Abelman, Frayne & Schwab

[57] ABSTRACT

In the processing of rapidly hardening flowable substances, especially glue, it is important to avoid hardening of glue residuals within the nozzle unit during temporary interruptions of operation. For this purpose, a liquid, especially water, is supplied through a nozzle duct so that the glue is rinsed out of an end section (31) facing the nozzle orifice (17). By closing the nozzle duct (16), a water column remains in the nozzle duct (16) and seals it towards the outside.

10 Claims, 2 Drawing Sheets

NOZZLE UNIT FOR APPLYING GLUE

BACKGROUND OF THE INVENTION

1. Field of the Invention

The invention relates to a nozzle unit for processing hardening materials, especially for applying glue to surfaces which are to be connected by means of adhesive bonding as, for example, folding tabs of packages, the nozzle unit having an outward-leading nozzle duct arranged downstream of a nozzle chamber.

2. Description of the Related Art

In packaging technology, attempts are increasingly made to apply glue points or glue lines to parts of packages to be bonded, namely folding tabs, by means of glue nozzles. The nozzle units which can be employed for this purpose have to be configured for high performance, specifically a high frequency in discharging small portions of glue.

Summary of the Invention

The invention is based on the object to develop and improve nozzle units for the processing of especially rapidly hardening glue such that the danger of undesired glue residues in the nozzle unit is avoided, and longer standstill phases do not result in malfunction in the nozzle unit.

To attain this object, the nozzle unit according to the invention is characterized in that for longer interruptions of operation at least one section of the nozzle duct is filled with a sealing liquid, especially water, the liquid being dischargeable from the nozzle duct when the operation started again.

The liquid, especially water, is a particularly well-suited material for temporarily sealing an orifice region of the nozzle unit. The glue present in the nozzle unit during an interruption of operation is prevented from hardening in this manner and is fully usable, namely flowable, when operation is started again.

The water or the like serving for the temporarily sealing is supplied to the nozzle or the nozzle duct through a separate water conduit. The nozzle duct is closed towards the outside during an interruption of operation and after the supply of water especially by means of a shut-off member adjoining the orifice of the nozzle duct.

Further features of the invention relate to the configuration of the nozzle unit, the nozzle chamber, and the closing member in the nozzle chamber. The latter is provided with a nozzle head which forms an end limitation of the nozzle chamber in the geometrical shape of a spherical cap. As a result, cavities in which glue residues can be accumulated are avoided.

The closing member is also configured in a special manner for the solution of the problem, namely with a preferably longitudinal bore for receiving a pressure member (spring), and with channels opening in the region of a cone-shaped closure head for connecting the longitudinal bore with the valve chamber.

DESCRIPTION OF THE PREFERRED EMBODIMENT(S)

Figure 1:
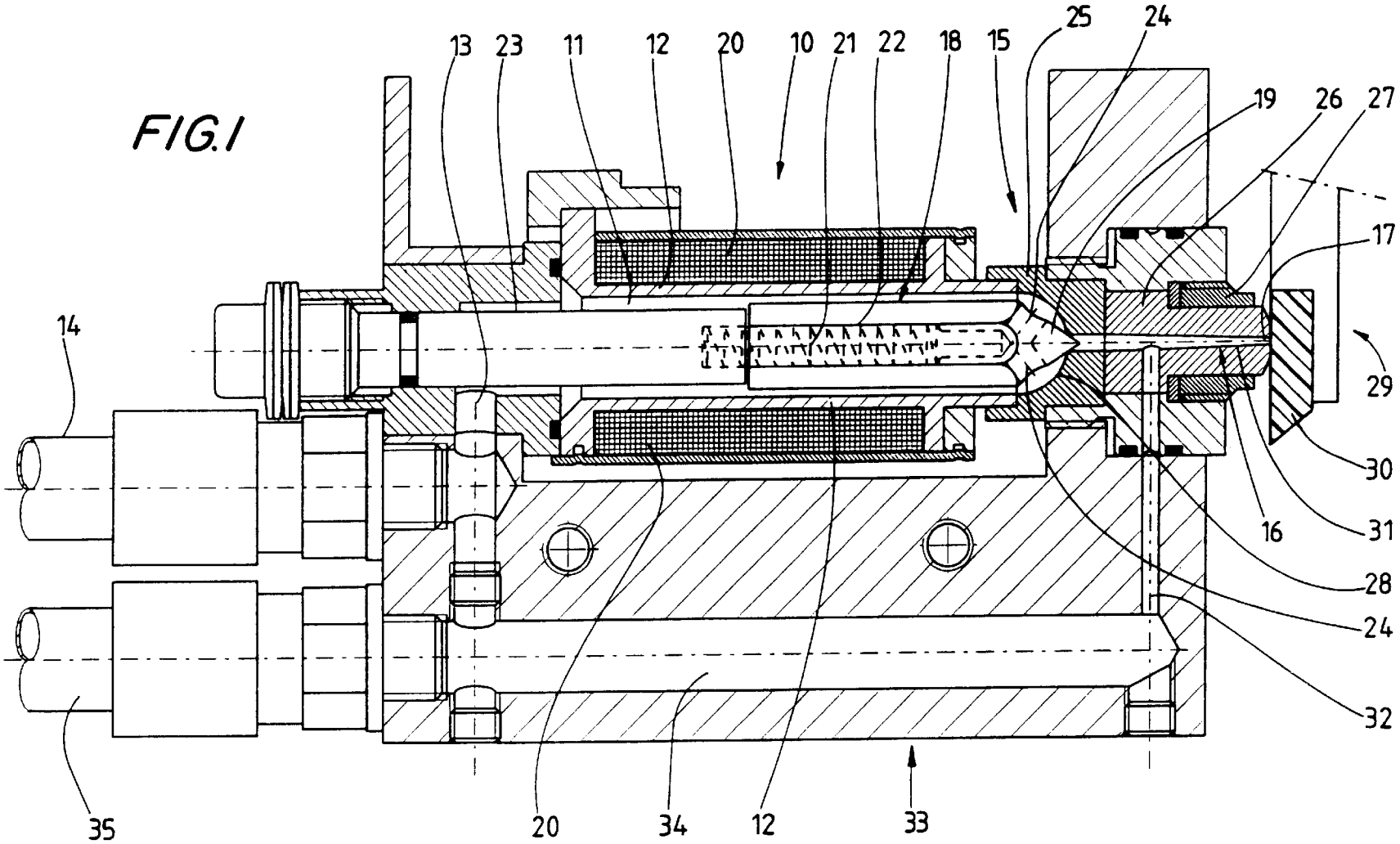
FIG. 1 is a longitudinal section of the nozzle unit.
Figure 2:
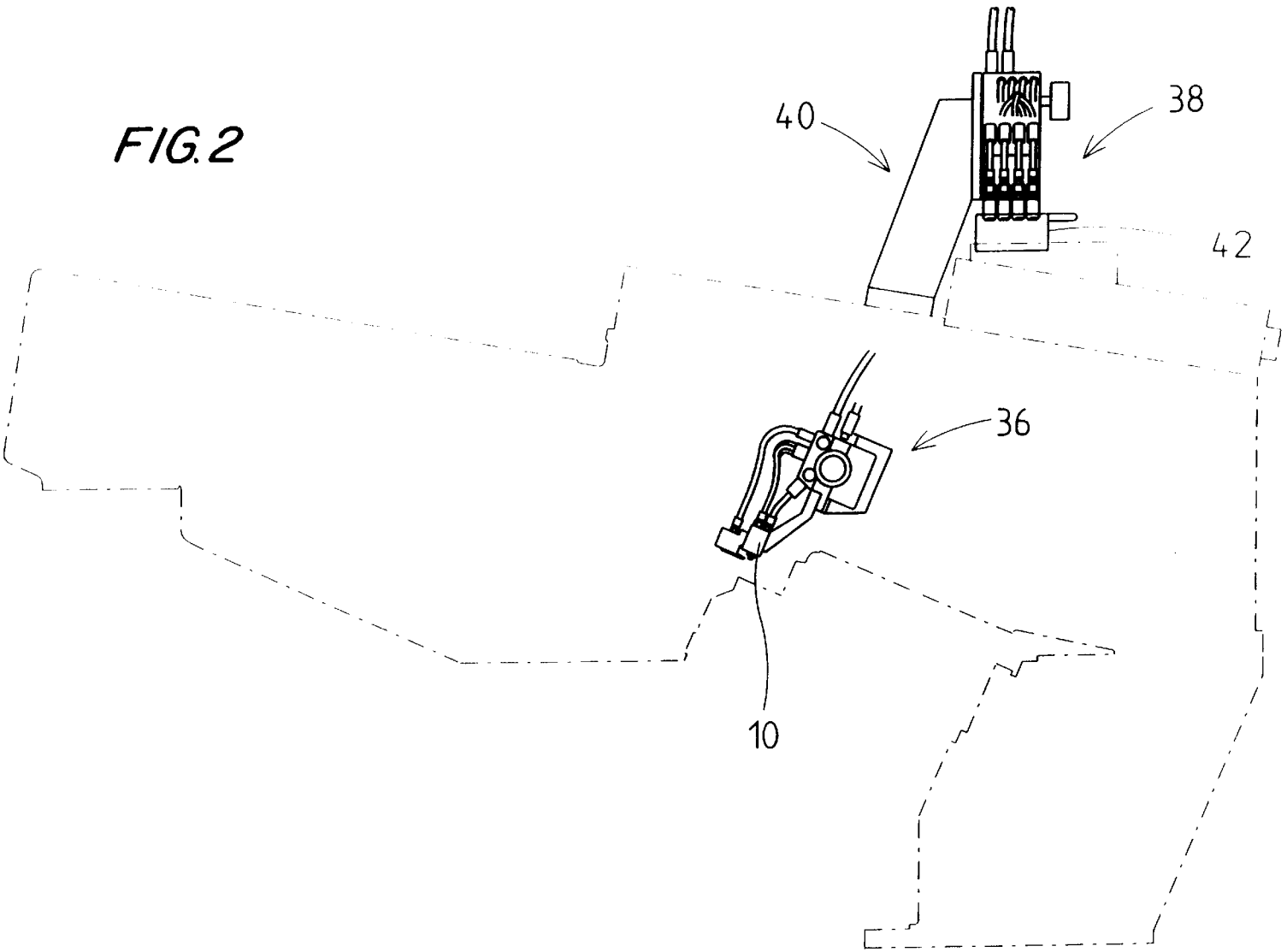
FIG. 2 is a schematic drawing of the nozzle unit in its operating position, along with a service station for the nozzle unit.

Further details and features of the nozzle unit according to the invention are explained below with reference to the exemplary embodiment shown in FIG.1. FIG.1 shows a longitudinal section of the nozzle unit.

The nozzle unit shown as an exemplary embodiment serves especially for the application of small, point-shaped glue portions to bases, especially to folding tabs of packages consisting of cardboard or the like. A nozzle housing 10 forms a nozzle chamber 11 in its interior. The nozzle chamber 11 is surrounded by a nozzle sleeve 12 with a circular or polygonal, especially hexagonal cross section. A glue channel 13, which is directed transverse axially in the present case, is arranged downstream of the nozzle chamber. This glue channel is connected to a glue reservoir or to a glue pump by means of a line 14.

On the opposite side of the glue channel 13, the nozzle housing 10 forms a nozzle head 15 in which an elongate nozzle duct 16 extends from the nozzle chamber 11 to a nozzle orifice 17. The glue—or another flowable substance—is conveyed to the outside through the nozzle duct 16.

A closure member 18 is mounted within the nozzle chamber 11 so as to be displaceable in the longitudinal direction, An end of the closure member facing the nozzle duct 16 is configured to have a converging cross-section, in the present case a cone-shaped closure head 19. A tapered end of this closure head 19 enters the nozzle duct 16 for temporarily closing the same. This closed position is shown in the drawing.

For opening and closing the nozzle duct 16, the closure member 18 can be moved to and fro in the longitudinal direction with a small displacement. The movements of the closure member 18 are effectuated electro magnetically. For this purpose the nozzle housing 18 is provided with an electric coil 20. The closure member 18 has the effect of a core and is retracted out of the closed position when the coil 20 is subjected to a current.

In the direction of the closed position, an elastic member, in the present case a (coil) spring 21, acts upon the closure member 18. This coil spring 21 sits in a central longitudinal bore 22 of the closure member 18. A free end is supported by a fixed stop 23 within the nozzle chamber 11 The bolt-like stop 23 also serves as a stop for the closure member 18.

Glue can penetrate into the longitudinal bore 22 though the open side. In order to create a flow-through effect, a particularity of the nozzle unit consists in that an inner end of the longitudinal bore 22 is connected to the nozzle chamber 11 by means of obliquely directed connecting bores 24. Consequently, glue can flow through the longitudinal bore 22 in the longitudinal direction.

A further particularity of the invention consists in the configuration of the nozzle head 15 which is comprised of a closing piece 25 of the nozzle chamber 11 and an adjoining end piece 26. Closing piece 25 and end piece 26 are separate parts which sealingly rest against one another or are pressed against one another in the region of a contact face, in the present case by means of a hollow nut 27.

The nozzle duct 16 extends centrally through the closing piece 25 and the end piece 26. In the region of the closing piece 25, the nozzle duct 16 is designed with a constant diameter. In the region of the end piece 26, however, the nozzle duct 16 has a conical cross-section which tapers in the direction of the nozzle orifice 17.

The closing piece 25 delimits the end region of the nozzle chamber 11 and forms a kind of valve seat for the closure head 19 in the region of the nozzle duct 16. The inside of the closing piece 25 is designed in such a manner that no cavities are formed in which glue can be accumulated. For this purpose, the closing piece 25 adjoins the housing sleeve 12 without any offset. An inner limitation 28 of the nozzle chamber 11 has a hollow, specifically hemispherical design in the region of the closing piece 25. Due to this design of the surface, the glue is always conducted in the direction towards the nozzle duct 16.

The closing piece 25 consists of a particularly hard material, especially ceramics. The end piece 26 preferably consists of plastic which prevents glue from sticking to it due its technological properties.

An outer shut-off member 29 is assigned to the nozzle unit or the nozzle head 15. In the present case, this shut-off member 29 is a finger which is mounted movably and synchronically with the nozzle unit. This finger rests against the nozzle orifice 17 in the closing position, especially during a relatively long interruption of operation. A sealing piece 30 made from a resilient material is arranged in the contact area. This sealing piece 30 rests against the end piece 26 in the closed position.

An important feature are measures by means of which the setting and drying of glue in the region of the nozzle duct 16 during an interruption of operation is avoided, even in a relative long standstill. To this end, the nozzle duct 16 or a section of the nozzle duct 16 facing the nozzle orifice 17 is rinsed with a flowing medium, especially a liquid, at the beginning of the interruption of operation, Water is preferably used for this purpose, if required with additives which are adapted to the glue. After the rinsing of the nozzle duct 16 or an end section 31 of the same, the liquid remains in the nozzle duct 16 or in this end section 31 and causes a liquid sealing towards the outside. The shut-off member 29 is located in the shown closing position.

The liquid, especially the water, is supplied through a separate channel, specifically through a water conduit 32 extending transversely relative to the nozzle duct 16. The water conduit 32 extends in the end piece 26 and opens towards the nozzle duct 16. A continuation of the water conduit 32 extends in a support 33 which is connected to the nozzle housing 10. In this support, the water conduit 32 is connected to a supply line 34 which is directed transversely, specifically parallel to the nozzle housing 10. This supply line 34 is connected to a water source or a pump.

With this apparatus, the nozzle unit is operated as follows: at the beginning of the interruption of operation the supply of glue is interrupted and water is supplied through the water line 35 and the water conduit 32. As a result, the glue present in the nozzle duct 16 in the region of the end portion 31 is rinsed out. After this, the nozzle orifice 17 is closed by means of the shut-off member 29. The end section of the nozzle duct 26 stays filled with water whereas glue stays in the remaining section of the nozzle duct 16 and in the nozzle chamber 11. No extra water is supplied so that merely the system of water conduits 32, 34 and the end section 31 of the nozzle duct 16 are filled with water.

When the operation of the nozzle unit is started again, the shut-off member 29 is first moved into the open position and then glue is supplied. The flowing glue first presses the water out of the nozzle duct 16 and then the nozzle unit is ready for operation again.

We claim:

1. Nozzle unit for processing free-flowing hardening materials, including applying glue to packages for gluing together of surfaces or folding tabs, said nozzle unit having a nozzle chamber (11) formed in a nozzle housing (10), the nozzle chamber (11) being connected to an outward-leading nozzle duct (16), said nozzle unit being characterized by the following features:

a. connected to the nozzle duct (16) in a transverse direction to the nozzle duct (16) is a water conduit (32), through which water or another suitable liquid can be led into the nozzle chamber (16), b. during an interruption in operation of the nozzle unit and while the nozzle unit remains stationary in its operating position, a closing member (18) can be moved into a closing position for closing the nozzle duct (16) and water can be led via the water conduit (32) into the nozzle duct in such a way that glue can be flushed out of an end section (31) of the nozzle duct (16) that faces a nozzle orifice (17), c. the end section (31) remains filled with water after the glue has been flushed out of the end section (31) of the nozzle duct (16), and d. after the interruption in operation, the closing member (18) is retracted from the nozzle duct (16) such that glue can be passed through the nozzle duct (16) in such a way that water can be forced out of the end section (31).

2. Nozzle unit according to claim 1, characterized in that the nozzle duct (16) can be closed in a region of the nozzle orifice (17) by a shut-off member (29) after the glue has been flushed.

3. Nozzle unit according to claim 1, characterized in that the water conduit (32) is connected to an admission channel (34), with the admission channel (34) and a sub-section of the water conduit (32) running outside of the nozzle housing (10) in a support (33) connected to the nozzle housing (10).

4. Nozzle unit according to claim 1, further comprising a service station (38) that is located at a distance from the operating position (36) of the nozzle unit for the optional reception of the nozzle unit during an interruption of operation, the service station (38) being provided with a support (40) for the nozzle unit and a spillage tray (42) for glue and water arranged below the nozzle unit.

5. Nozzle unit as claimed in claims 1, characterized in that the nozzle chamber (11) is elongated and has a hemispherical closing surface (28) in a region of transition to the nozzle duct (16).

6. Nozzle unit according to claim 1, characterized in that formed in the closing member (18) is a longitudinal boring (22) open at one side for receiving a spring (21), and in that the longitudinal boring (22) is connected to the nozzle chamber (11) by connecting bores (24) at an end of the closing member (18) facing the nozzle duct (16), said connecting bores (24) being in a region of a closure head (19).

7. Nozzle unit according to claim 1, characterized in that for the reception of the nozzle duct (16), a nozzle head (15) is comprised of at least two parts which tightly abut one another, a closing piece (25) and an adjoining end piece (26), the nozzle duct (16) extending continuously in a region of the closing piece (25) and the end piece (26) up to the nozzle orifice (17).

8. Nozzle unit for processing free-flowing hardening materials, including applying glue to folding tabs of packages to be bonded together adhesively, with an elongated nozzle chamber (11) formed in a nozzle housing (10), the nozzle chamber (11) being connected to an outward-leading nozzle duct (16), characterized in that the elongated nozzle chamber (11) is limited by a separate closing piece (25) at the outlet side, said closing piece (25) being made of ceramics, an inner limiting surface (28) of the closing piece (25) being spherically formed, with the nozzle duct (16)

being centrally arranged, water being employed to flush glue out of an end section (31) of the nozzle duct (16) during an interruption of operation of the nozzle unit, and to remain in the end section (31) until operation of the nozzle unit resumes.

9. Nozzle unit for processing free-flowing hardening materials, including applying glue to folding tabs of packages to be bonded together adhesively, with a nozzle chamber (11) formed in a nozzle housing (10), the nozzle chamber (11) being connected to an outward-leading nozzle duct (16), characterized in that the nozzle duct (16) can be closed by means of an electromagnetically movable closing member (18) with a spherically tapered closure head (19), water being employed to flush glue out of an end section (31) of the nozzle duct (16) during an interruption of operation of the nozzle unit, and to remain in the end section (31) until operation of the nozzle unit resumes.

10. Nozzle unit as claimed in claim 9, characterized in that, in the closing member (18), there is formed an elongate bore (22) which is open at one side for receiving a spring (21), and in that the elongate bore (22) is connected to the nozzle chamber (11) by connecting bores (24) at an end of the elongate bore (22) which is facing the nozzle duct (16), in region of the closure head (19).

* * * * *